United States Patent [19]

Tuschy et al.

[11] 4,154,076

[45] May 15, 1979

[54] ROLLER FOR SKEW ROLLING MILL

[75] Inventors: Eckhard Tuschy; Georg Wischmeyer, both of Osnabruck, Fed. Rep. of Germany

[73] Assignee: Kabel-und Metallwerke Gutehoffnungshuette AG, Fed. Rep. of Germany

[21] Appl. No.: 888,000

[22] Filed: Mar. 20, 1978

[30] Foreign Application Priority Data

May 25, 1977 [DE] Fed. Rep. of Germany ..... 2723506

[51] Int. Cl.[2] ..... B21B 27/08

[52] U.S. Cl. ..... 72/69; 72/78

[58] Field of Search ..... 72/69, 77, 78, 95, 100

[56] References Cited

U.S. PATENT DOCUMENTS

| | | | |
|---|---|---|---|
| 1,914,412 | 6/1933 | Eksergian | 72/69 |
| 2,034,284 | 3/1936 | Diescher | 72/69 |
| 3,735,617 | 5/1973 | Bretschneider | 72/100 |

*Primary Examiner*—Lowell A. Larson

*Attorney, Agent, or Firm*—Marn & Jangarathis

[57] ABSTRACT

A working roller for a skew rolling mill which has the shape of a truncated cone is provided with internal passages for circulating a heat transfer medium therethrough to thereby control the temperature of the working surface of the roller.

1 Claim, 1 Drawing Figure

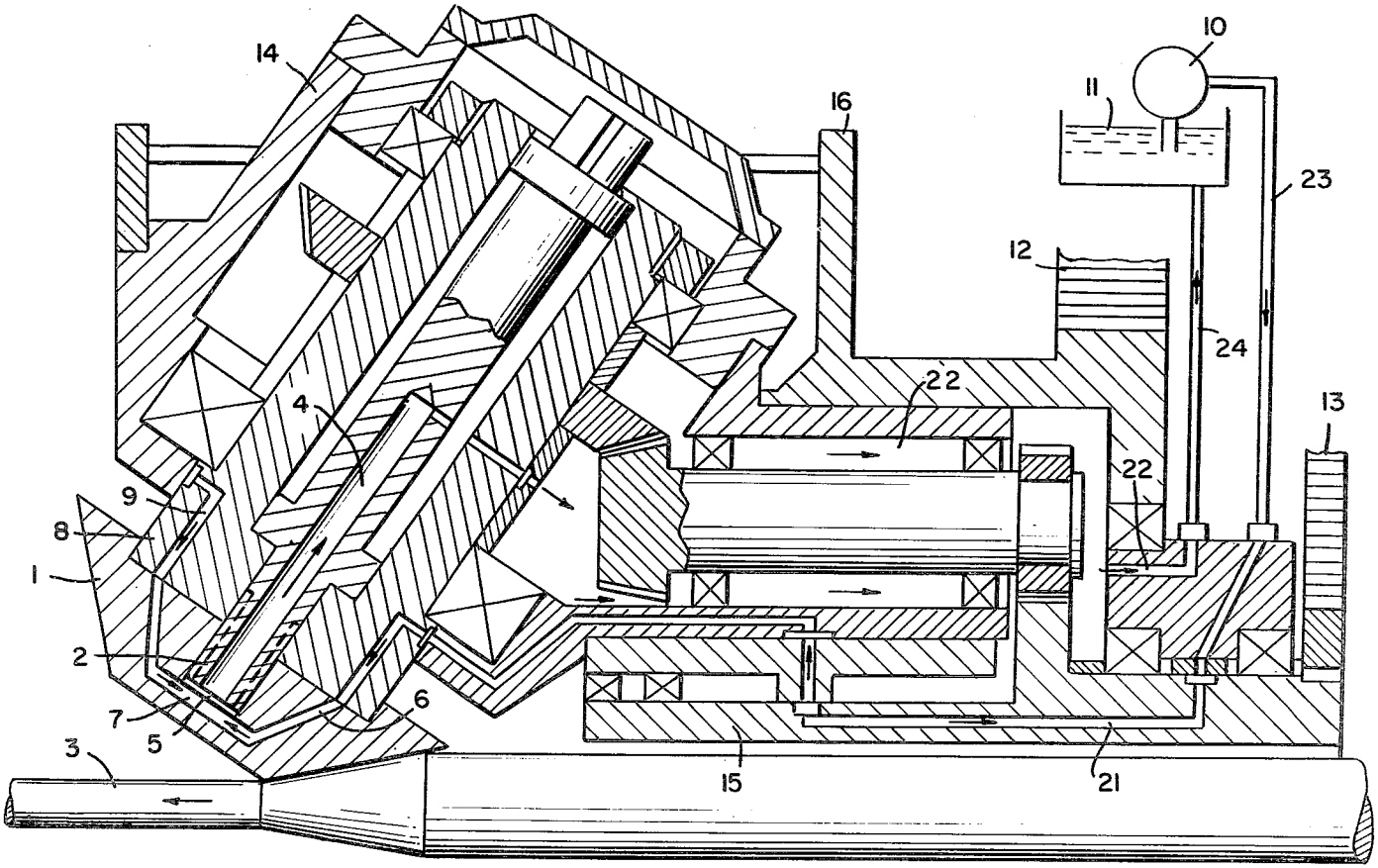
10
11
12
13
14
15
16
21
22
22
23
24
1
2
3
4
5
6
7
8
9

ROLLER FOR SKEW ROLLING MILL

The present invention relates to skew rolling mills.

A planetary skewed rolling mill is known from U.S. Pat. No. 3,735,617. It has been found that in using such a rolling mill, the conditions in the roll gap change continuously. It is believed that such changes primarily result from roller temperature changes caused by the high deformation energy. Attempts to cool the roller by the application of an emulsion thereto were not successful as a result of the adverse influence on the gripping qualities.

In accordance with the present invention, there is provided a working roller for a skew rolling mill having the shape of a truncated cone and including means for circulating a heat transfer medium through the interior of the roller for controlling the temperature of the working surface thereof. In this manner, the temperature of the roller can be controlled to provide for essentially constant deformation conditions in the roll gap.

In accordance with the preferred embodiment, the skew working roller is provided with a plurality of circumferentially spaced inclined passages which are interconnected through a cross-passage with an axial passage, with the heat transfer medium being introduced into the inclined passages and flowing therefrom to the axial passage for withdrawal from the working roller. The working rollers may also be preferably provided with a suitable control means which measures the temperature of the working surface of the rollers and which adjusts the flow and/or temperature of the heat transfer medium which flows through the interior roller passages to thereby maintain a selected predetermined temperature.

Particularly in the case of copper as material to be rolled, a temperature of 300° C. has proven beneficial to the rollers. It is expedient to heat the rollers to a temperature of 300° C. before starting to roll. This is done expediently with the heat transfer medium heated for this purpose. Since the conventional heat transfer medium, water, at these high temperatures does not seem suitable because of its low boiling point, oil is used to greater advantage as a heat transfer medium. Also, the use of oil has the advantage of being usable as a lubricant. In order not to change the conditions in the roll gap due to scale or oxide layers which might adhere to the stock to be rolled, another improvement provides means of keeping the stock to be rolled under a protective medium, preferably a protective gas. It is also expedient to protect the rolled stock against oxidation. By avoiding oxide coatings, the slip of the rollers is kept constant. It is self-understood that in the case of hot-rolling, the annealing of the blocks to be rolled must also take place under protective gas.

The skew rolling mill in accordance with this invention can be used to great advantage for reducing the cross section of stock material of nonferrous metal with an initial diameter of less than 65 mm.

The invention is explained in detail by the embodiment shown in the drawing wherein:

The drawing is a partially schematic sectional view of an embodiment of the invention.

For the sake of clarity, the drawing shows only one working roller 1 of a planetary skew rolling mill in accordance with U.S. Pat. No. 3,735,617, which is hereby incorporated by reference.

Referring to the drawing, frustroconically shaped working roller 1 is fastened to a working roller shaft 2 in roller carrier housing 14. As known in the art, the housing 14 is rotatably driven about the axis of stock 3 which is to be rolled, and the working roller 1 is rotatably driven in housing 14 about an axis which intersects with the stock to be rolled. The working roller 1 reduces the cross section of the stock, and as a result of the angular displacement thereof with respect to the axis of the stock, the stock is moved in the direction of the arrow. The general construction and operation of the rolling mill is known in the art and, accordingly, no further details in this respect are deemed necessary for a complete understanding of the invention.

The working roller shaft 2 is a hollow shaft and therefore has a bored hole 4. The working roller shaft 2 is connected to the roller body 1 by means of a thread with key seating in a force-locked manner. The bore with the thread in the roller body 1 is longer than that part of the working roller shaft 2 projecting into the roller body 1 and forms a cavity 5. Passages 6, preferably six to eight in number, are provided at an angle with the axis of rotation of the roller body 1, and discharge into a cross bore 7 which also is connected to cavity 5. A roller carrier 8, which has drill holes 9 in the direction of the lengthwise axis which line up with the passages 6 in the roller body 1, is fitted into the face surface of the roller body 1.

Heat transfer liquid is provided to the drill holes 9 through a heat transfer fluid supply passage, generally designated as 21, which extends through the mill, and heat transfer liquid is withdrawn from the bored hole 4 in the roller shaft through a heat transfer liquid withdrawal passage, generally designated as 22, with the direction of flow being indicated by suitable arrows.

The heat transfer liquid is withdrawn from a suitable reservoir 11 by pump 10 and is supplied to the supply passage 21 in the mill through line 23. Heat transfer liquid is returned to reservoir 11 through line 24 which is connected to the withdrawal passage 22. The reservoir may include suitable means for adjusting the temperature of the heat transfer liquid, or the temperature of the heat transfer liquid may be adjusted apart from the reservoir and provided to the reservoir at the appropriate temperature. Alternatively, the lines 23 or 24 may include a suitable heat exchanger for regulating the temperature of the heat transfer liquid. Oil is used as an expedient heat transfer medium. The passages in the roller body 6, and the cross bore 7 are located in such a way that they do not appreciably reduce the strength of roller body 1, but are sufficiently close to the working surface of roller body 1 that they can carry the heat in the roll gap away. At the start of the rolling process, the passages 9, 6 and 7 and cavity 5 and bored hole 4 are used for delivery and discharge of a heating medium which preheats the working roller 1 to a prescribed temperature, for example 300° C. Subsequently, the heat transfer medium functions to cool the roller. If the temperature of 300° C. is exceeded because of the deformation energy of the intrinsic heat of the stock 3 to be rolled in a hot rolling operation, which can be determined by measuring the surface temperature of the roller body 1, the cooling effort of the cooling system is increased.

Although the embodiment has been described with respect to a particular flow pattern for the heat transfer medium, it is to be understood that other flow patterns can be employed; e.g., flow can be in a direction opposite to that particularly shown.

Numerous modifications and variations of the present invention are possible in light of the above teachings and, therefore, within the scope of the appended claims the invention may be practised otherwise than as particularly described.

We claim:

1. In a skew rolling mill including a rotatably driven working roller, a rotatably driven working roller carrier including a working roller shaft connected to the working roller, the improvement comprising:

said working roller having a truncated cone shape and including a plurality of circumferentially spaced inclined longitudinal passages, an axial passage and cross-passage for interconnecting the inclined passages with the axial passage, said working roller shaft being hollow with the hollow interior thereof being aligned with the axial passage, and said working roller carrier including passages connected to said inclined passages and the hollow roller shaft whereby a heat transfer medium can be provided to and withdrawn from the working roller through the working roller carrier for passage through the inclined working roller passages to control the temperature of the working surface of the working roller and thereby maintain a selected predetermined temperature.

* * * * *